US011369224B2

(12) United States Patent
Hanley

(10) Patent No.: US 11,369,224 B2
(45) Date of Patent: Jun. 28, 2022

(54) CURTAIN HOLDBACK

(71) Applicant: Kenney Manufacturing Company, Warwick, RI (US)

(72) Inventor: Michael P. Hanley, Smithfield, RI (US)

(73) Assignee: Kenney Manufacturing Company, Warwick, RI (US)

( * ) Notice: Subject to any disclaimer, the term of this patent is extended or adjusted under 35 U.S.C. 154(b) by 0 days.

(21) Appl. No.: 17/024,995

(22) Filed: Sep. 18, 2020

(65) Prior Publication Data

US 2021/0137297 A1 May 13, 2021

Related U.S. Application Data

(60) Provisional application No. 62/934,800, filed on Nov. 13, 2019.

(51) Int. Cl.
*A47H 19/00* (2006.01)

(52) U.S. Cl.
CPC ..... *A47H 19/00* (2013.01)

(58) Field of Classification Search
CPC ..... A47H 19/00; A47H 1/12; A47H 1/122; A47H 1/124; A47H 1/13; A47H 1/14; A47H 1/142
See application file for complete search history.

(56) References Cited

U.S. PATENT DOCUMENTS 1,472,599 A * 10/1923 Kirsch ..... A47H 19/00 248/308
1,615,215 A * 1/1927 Cokefair ..... A47H 19/00 248/305
1,666,408 A * 4/1928 Dalton ..... A47H 19/00 248/308
1,696,089 A * 12/1928 Huey ..... A47H 19/00 248/308
1,743,608 A * 1/1930 Kenney ..... A47H 1/142 248/263
1,763,811 A * 6/1930 Occhiuzzo ..... A47H 19/00 160/340
2,053,332 A * 9/1936 Gossner ..... A47H 21/00 160/349.2
2,119,815 A * 6/1938 Huber ..... A47H 19/00 248/208
2,194,065 A * 3/1940 Boye ..... A47H 19/00 248/304
4,022,415 A * 5/1977 Roderick ..... A47H 19/00 248/298.1
4,559,988 A * 12/1985 Nocerino ..... A47H 19/00 160/349.2
5,010,942 A * 4/1991 Hung ..... A47H 19/00 160/349.1
5,069,264 A * 12/1991 Klawiter ..... E06B 9/325 160/178.1 R (Continued)

*Primary Examiner* — Johnnie A. Shablack
(74) *Attorney, Agent, or Firm* — Adler Pollock & Sheehan P.C.

(57) ABSTRACT

A device includes a front mounting plate having an aperture, a holdback arm having a generally flat proximal end with an aperture, and a rear mounting plate having a single central aperture and two mounting apertures configured at a 45° angle to a surface of the rear mounting plate, the holdback arm configured to be sandwiched between the front and rear mounting plates.

13 Claims, 6 Drawing Sheets

(56) References Cited

U.S. PATENT DOCUMENTS

| | | | | |
|---|---|---|---|---|
| 5,749,558 | A * | 5/1998 | Wallo | A47G 1/1633<br>248/475.1 |
| 6,296,042 | B1 * | 10/2001 | Hung | A47H 19/00<br>160/349.2 |
| 8,539,691 | B2 * | 9/2013 | Daniel | F16M 11/045<br>33/645 |
| 11,111,942 | B2 * | 9/2021 | Cogburn | F16B 15/02 |
| 11,143,360 | B2 * | 10/2021 | Brownstone | F16B 2/04 |
| 2021/0137297 | A1 * | 5/2021 | Hanley | A47H 19/00 |

* cited by examiner

CURTAIN HOLDBACK

CROSS REFERENCE TO RELATED APPLICATIONS

This application claims benefit from U.S. Provisional Patent Application Ser. No. 62/934,800, filed Nov. 13, 2019, which is incorporated by reference in its entirety.

BACKGROUND OF THE INVENTION

The present invention relates generally to curtain and specifically to a curtain holdback.

In general, curtain hardware comes in a variety of types, such as, for example, holdbacks, tiebacks, knobs and so forth. Curtain holdbacks evolved alongside curtains as a way to keep a curtain clear of a bed, room division or window. Traditional holdbacks are U-shaped metal or wood fixtures, which one tucks the curtain into, creating a simple, clean look. Curtain holdbacks come in a variety of shapes, colors and sizes, from elegant to whimsical.

SUMMARY OF THE INVENTION

The following presents a simplified summary of the innovation in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In general, in one aspect, the invention features a device including a front mounting plate having an aperture, a holdback arm having a generally flat proximal end with an aperture, and a rear mounting plate having a single central aperture and two mounting apertures configured at a 45° angle to a surface of the rear mounting plate, the rear mounting plate secured to a mounting surface by two nails driven into the mounting surface through the two mounting apertures, the proximal end of the holdback arm positioned and removeably fixated between the front mounting plate and the rear mounting plate with a thumb screw placed through the aperture of the front mounting plate, the aperture of the proximal end of the holdback arm and the central aperture of the rear mounting plate.

In another aspect, the invention features a device including a front mounting plate having an aperture, a holdback arm having a generally flat proximal end with an aperture, and a rear mounting plate having a single central aperture and two mounting apertures configured at a 45° angle to a surface of the rear mounting plate, the holdback arm configured to be sandwiched between the front and rear mounting plates.

In still another aspect, the invention features a method including providing a front mounting plate having an aperture, providing a rear mounting plate having a single central aperture and two mounting apertures configured at a 45° angle to a surface of the rear mounting plate, securing the rear mounting plate to a horizontal surface, and securing a holdback arm having a generally flat proximal end with an aperture between the front mounting plate and the rear mounting plate.

Embodiments of the invention may have one or more of the following advantages.

The curtain holdback uses two nails to install it to a wall. This method is much easier than drilling, i.e., it requires less tools using just a hammer for installation. If the curtain holdback is ever un-installed, very little damage is left behind on the wall.

The curtain holdback is installed with 2 nails one half inch apart at a 45 degree angle.

The mounting plates of the curtain holdback conceal the mounting hardware.

One mounting plate has indexing surfaces molded into it that enable installation horizontally or at a 20 degree angle, up or down.

Another mounting plate goes against the wall and holds the nails at a 45 degree angle during installation.

The two mounting plates and holdback arm are held together with a thumb screw.

These and other features and advantages will be apparent from a reading of the following detailed description and a review of the associated drawings. It is to be understood that both the foregoing general description and the following detailed description are explanatory only and are not restrictive of aspects as claimed.

BRIEF DESCRIPTION OF THE DRAWINGS

These and other features, aspects, and advantages of the present invention will become better understood with reference to the following description, appended claims, and accompanying drawings where:

DETAILED DESCRIPTION

Figure 1:
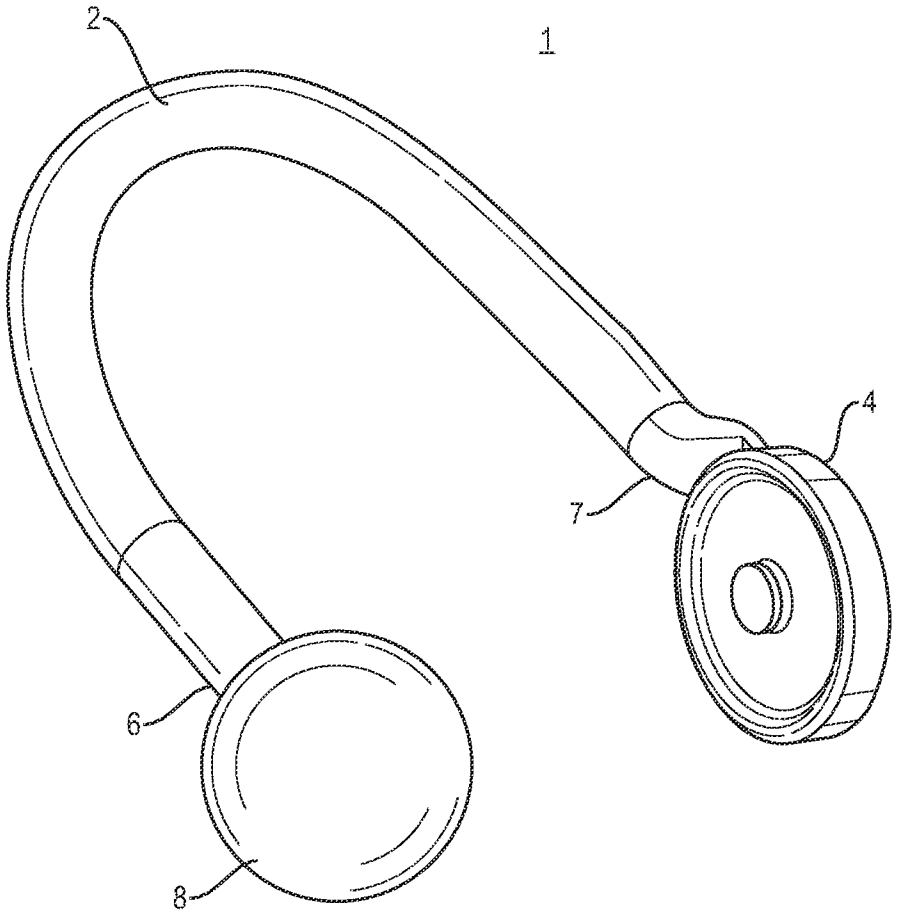
FIG. 1 illustrates an exemplary curtain holdback.

The subject innovation is now described with reference to the drawings, wherein like reference numerals are used to refer to like elements throughout. In the following description, for purposes of explanation, numerous specific details are set forth in order to provide a thorough understanding of the present invention. It may be evident, however, that the present invention may be practiced without these specific details. In other instances, well-known structures and devices are shown in block diagram form in order to facilitate describing the present invention.

As shown in FIG. 1, an exemplary curtain holdback 1 includes a holdback arm 2 and a mounting assembly 4. In the embodiment illustrated, the holdback arm 2 is generally a horseshoe shaped rod and includes a proximal end 6 and a distal end 7. As will be described subsequently, the proximal end 7 is generally flat and configured to mate with an interior of the mounting assembly 4. The distal end 7 of the holdback arm 2 is configured to receive a crowning ornament or detail 8, sometimes referred to as a finial, such as a decorative knob.

Figure 2:
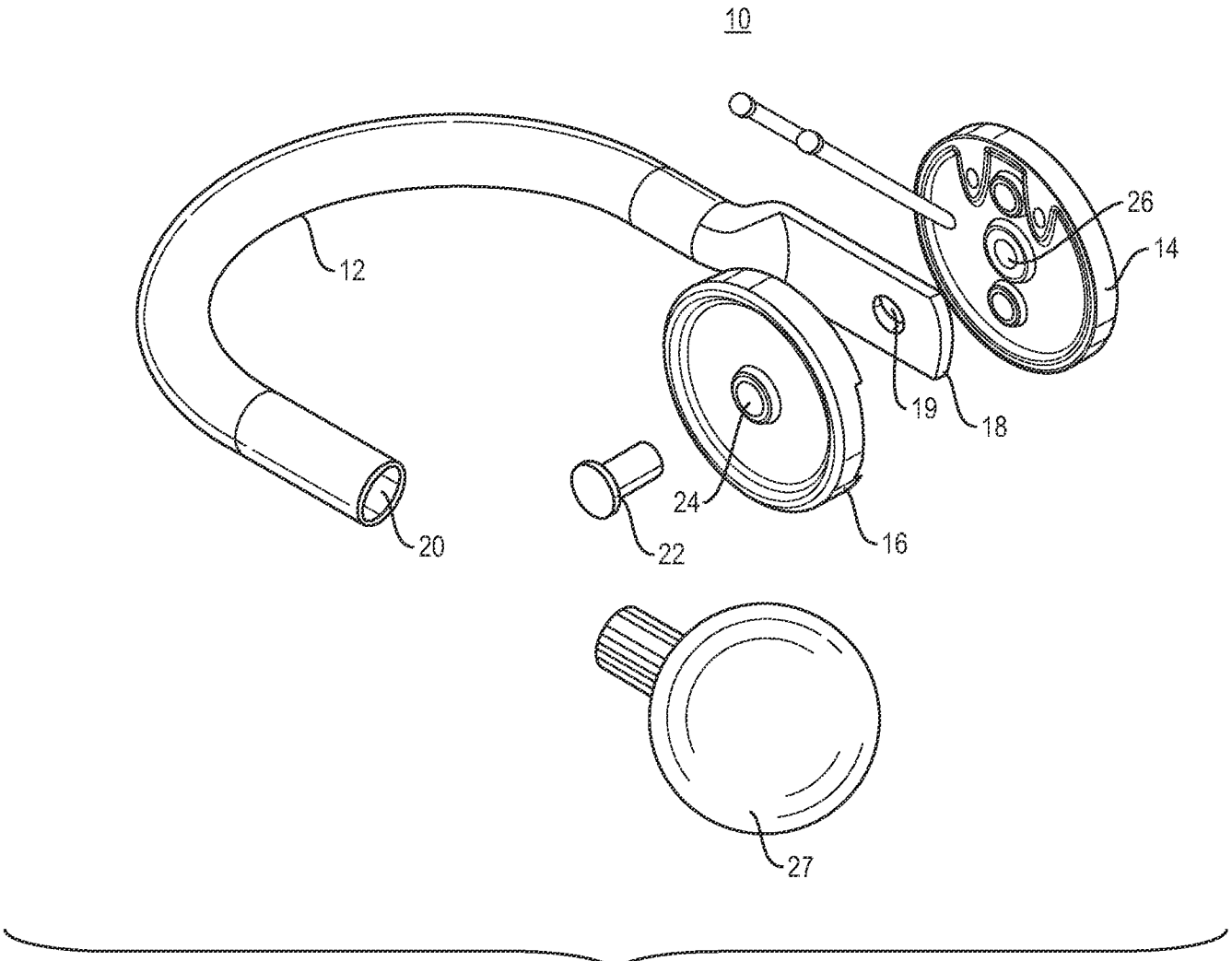
FIG. 2 illustrates an exploded view of a curtain holdback.

As shown in FIG. 2, an exemplary curtain holdback 10 is illustrated in an exploded view and includes a holdback arm 12, a rear mounting plate 14 and a front mounting plate 16. In one embodiment, the holdback arm 12, as shown, is generally a horseshoe shaped rod. In the embodiment shown, the holdback arm 12 includes a proximal end 18 and a distal end 20. The proximal end 18 is generally flat with a central orifice 19. As such, the proximal end 18 is configured to fit snugly between the rear mounting plate 14 and the front mounting plate 16 when the rear mounting plate 14 and the front mounting plate 16 are pressed or clamed together. More specifically, the proximal end 18 is placed over the rear mounting plate 14 and the front mounting plate 16 placed over the proximal end 18 and mated to the rear mounting plate 14. Once the three pieces 14, 16, 18 come in contact with each other, a thumb screw 22 is threaded through a central orifice 24 in the front mounting plate 16, through the orifice 19, and into a central orifice 26 of the rear mounting plate 14. To enable a snug fit the orifices 24, 26 are threaded to receive the thumb screw 22. The result is the proximal end 18 of the holdback arm 12 is is held securely in place by being press fitted between the front mounting plate 16 and the rear mounting plate 14.

The distal end 20 of the holdback arm 12 is configured to receive a crowning ornament or detail 27, sometimes referred to as a finial, such as a decorative knob.

Figure 3C:
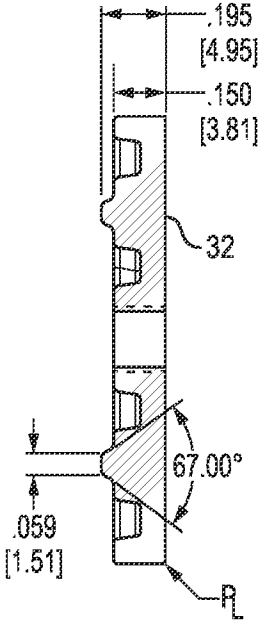
FIGS. 3A, 3B and 3C illustrate several views of the rear mounting plate.
Figure 3B:
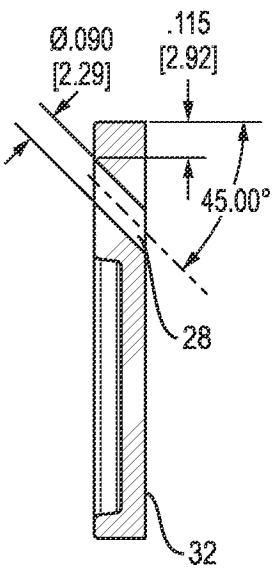
Figure 3A:
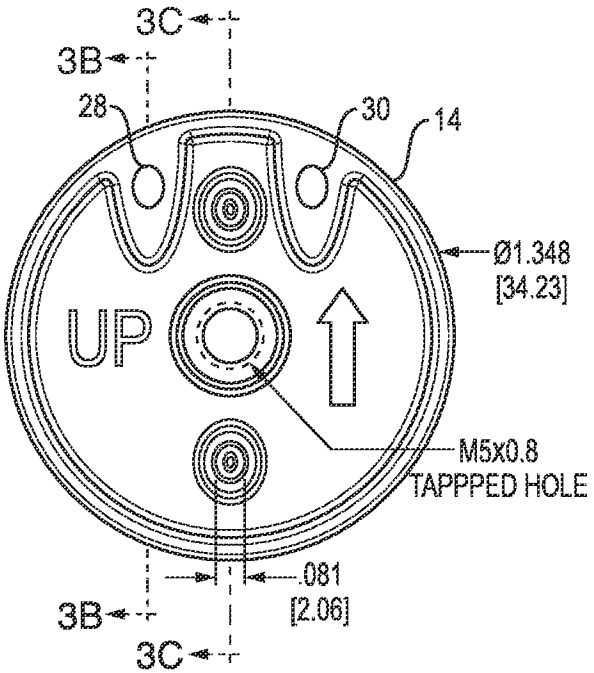

As shown in FIGS. 3A, 3B and 3C, the rear mounting plate 14 includes a first opening 28 and a second opening 30. Each of the openings are configured to receive mounting hardware, such as a nails, at a 45° angle to a mounting surface 32, such as a wall or strip of molding. Installation of the curtain holdback 10 starts by placing the rear mounting plate 14 against the mounting surface 32. Nails are driven into the mounting surface 32 at a 45° angle through the openings 28, 30, securing the rear mounting plate 14 to the mounting surface 32. No drilling, placement of anchors, or any other preparation is required.

A next step in the installation of the curtain holdback 10 is to place the proximal end 18 of the holdback arm 12 over the rear mounting plate 14, aligning the central orifice 26 with the the orifice 19. Installation is completed by placing the front mounting plate 16 over the proximal end 18, aligning the central orifice 24 with the orifice 19 and central orifice 26, and securing the rear mounting plate 14, the front mounting plate 16 and proximal end 18 with the thumb screw 22.

Figure 4C:
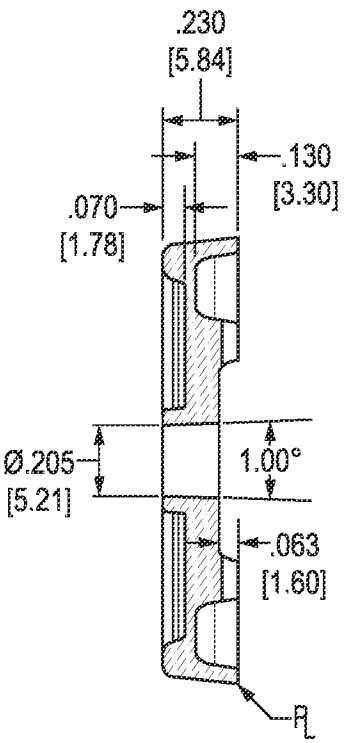
FIGS. 4A, 4B and 4C illustrate several views several views of the front mounting plate.
Figure 4B:
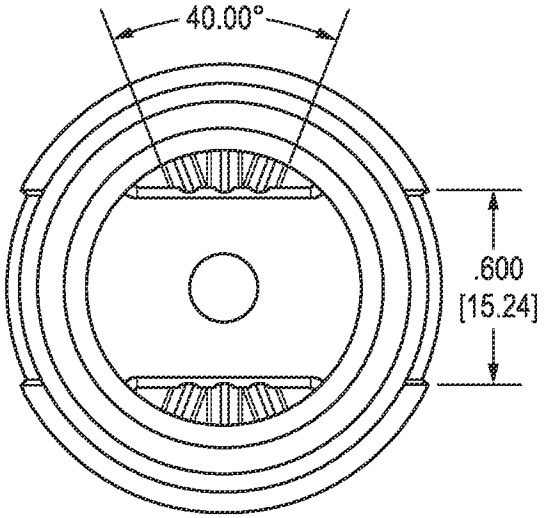
Figure 4A:
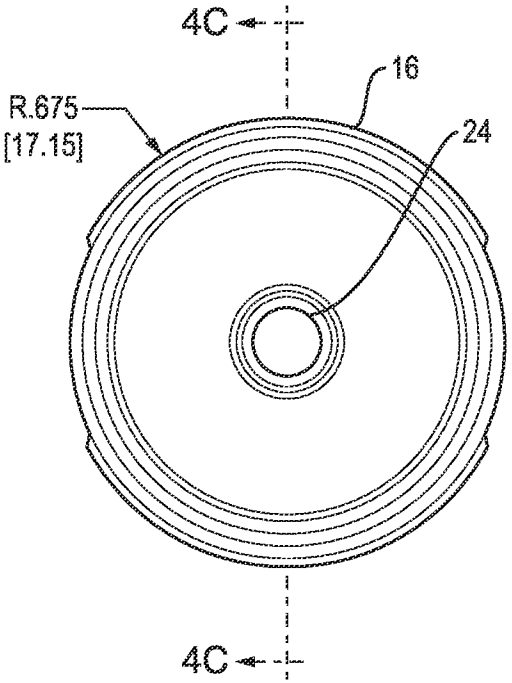

FIGS. 4A, 4B and 4C illustrate the front mounting plate 16.

In summary, the curtain holdback 10 is installed with mounting hardware (e.g., two nails ½" apart) at a 45° angle. The mounting plates 14, 16 conceal the mounting hardware. rear mounting plate 14 goes against a wall and holds the nails at a 45 degree angle during installation. The mounting plates 14, 16 and holdback arm 12 are held together with a thumb screw 22.

Figure 5:
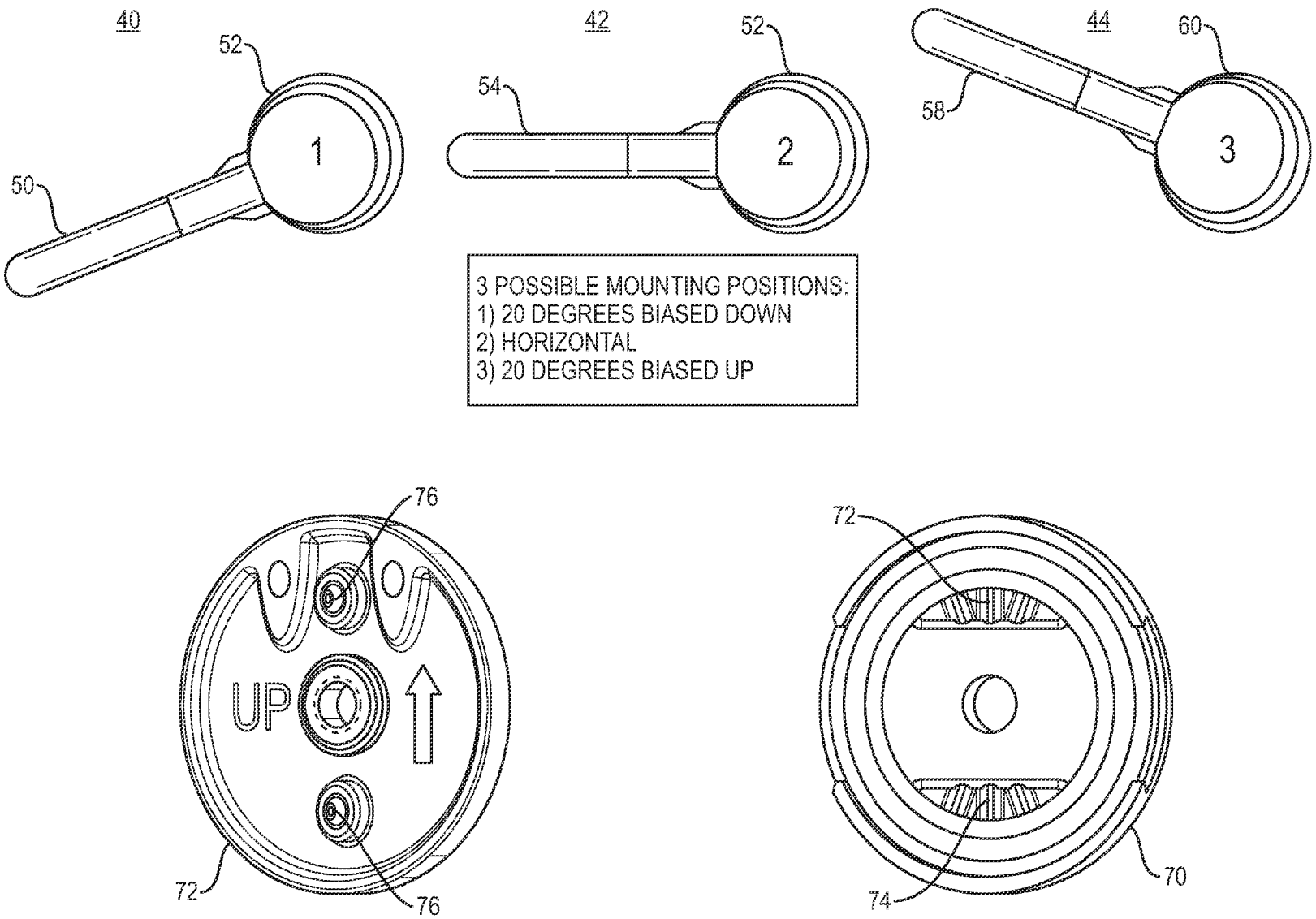
FIG. 5 illustrates exemplary assembled preset mounting configurations.

In one embodiment, the curtain holdback described herein may be assembled into one of multiple preset mounting configurations. As shown in FIG. 5, three assembled preset mounting configurations 40, 42 and 44 are shown.

In mounting configuration 40, a holdback arm 50 is positioned 20° biased down from a front mounting plate 52. In mounting configuration 42, a holdback arm 54 is horizontal to a front mounting plate 56. In mounting configuration 44, a holdback arm 58 is positioned 20° biased up from a front mounting plate 60. These preset mounting configurations 40, 42 and 44 are enabled by the presence of features on a front mounting plate 70 and rear mounting plate 72.

More specifically, an interior of the front mounting plate 70 includes negative detents 74 that are configured to align with positive control posts 76 of rear mounting plate 72. Positioning the central detent of the front mounting plate 70 over the positive control posts 76 of the rear mounting plate 72 results in the mounting configuration 42, while positioning the detents over positive control posts 76 20° either direction of center result in mounting configuration 40 or mounting configuration 44. Traditional holdbacks do not offer these features.

Although three mounting configurations are illustrated, other mounting configurations are possible with other arrangements of negative detents on a rear mounting plate.

Figure 6:
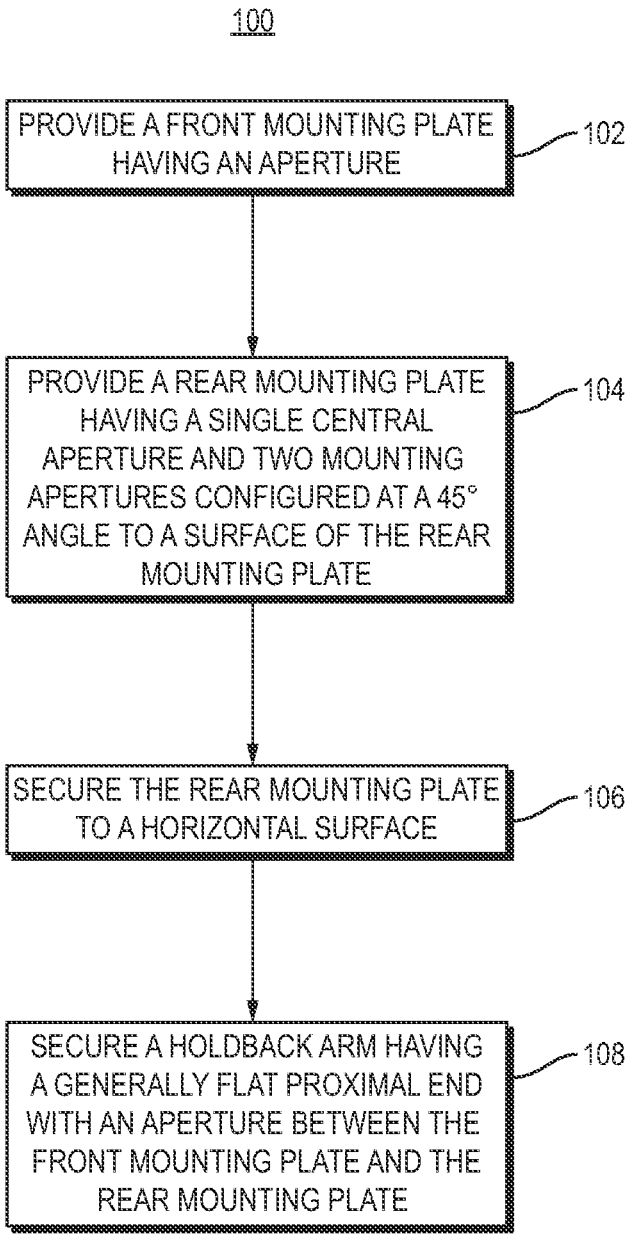
FIG. 6 is a flow diagram.

As shown in FIG. 6, a process 100 includes providing (102) a front mounting plate having an aperture.

Process 100 provides (104) a rear mounting plate having a single central aperture and two mounting apertures configured at a 45° angle to a surface of the rear mounting plate.

Process 100 secures (106) the rear mounting plate to a horizontal surface.

Process 100 secures (108) a holdback arm having a generally flat proximal end with an aperture between the front mounting plate and the rear mounting plate.

It would be appreciated by those skilled in the art that various changes and modifications can be made to the illustrated embodiments without departing from the spirit of the present invention. All such modifications and changes are intended to be within the scope of the present invention except as limited by the scope of the appended claims.

What is claimed is:

1. A device comprising:

a front mounting plate having a threaded aperture;

a holdback arm having a generally flat proximal end with an aperture; and a rear mounting plate having a single central threaded aperture and two mounting apertures configured at a 45° angle to a surface of the rear mounting plate, the front mounting plate covering the two mounting apertures, the rear mounting plate secured to a mounting surface by two nails driven into the mounting surface through the two mounting apertures, the proximal end of the holdback arm positioned and removeably fixated between the front mounting plate and the rear mounting plate with a thumb screw placed through the threaded aperture of the front mounting plate, the aperture of the proximal end of the holdback arm and the threaded central aperture of the rear mounting plate.

2. The device of claim 1 wherein the holdback arm comprises a distal end.

3. The device of claim 2 wherein the distal end is configured to receive a crowning ornament.

4. The device of claim 2 wherein the distal end is configured to receive a detail.

5. The device of claim 2 wherein the distal end is configured to receive a decorative knob.

6. The device of claim 1 wherein the front mounting plate comprises negative detents configured to mate with positive control posts located on the rear mounting plate.

7. A device comprising:

a front mounting plate having a threaded aperture;

a holdback arm having a generally flat proximal end with an aperture; and a rear mounting plate having a single threaded central aperture and two mounting apertures configured at a 45° angle to a surface of the rear mounting plate, the holdback arm configured to be sandwiched between the front and rear mounting plates, the front mounting plate covering the two mounting apertures.

8. The device of claim 7 wherein the rear mounting plate is secured to a mounting surface by two nails driven into the mounting surface through the two mounting apertures.

9. The device of claim 8 wherein the proximal end of the holdback arm is positioned and removeably fixated between the front mounting plate and the rear mounting plate with a thumb screw placed through the aperture of the front mounting plate, the aperture of the proximal end of the holdback arm and the central aperture of the rear mounting plate.

10. The device of claim 7 wherein the holdback arm comprise a distal end.

11. The device of claim 10 wherein the distal end is configured to receive a crowning ornament.

12. The device of claim 10 wherein the distal end is configured to receive a detail.

13. The device of claim 10 wherein the distal end is configured to receive a decorative knob.

* * * * *